US009209543B2

(12) United States Patent
Yokoyama et al.

(10) Patent No.: US 9,209,543 B2
(45) Date of Patent: Dec. 8, 2015

(54) REVERSIBLE CONNECTOR

(71) Applicant: JAPAN AVIATION ELECTRONICS INDUSTRY, LIMITED, Shibuya-ku, Tokyo (JP)

(72) Inventors: Yohei Yokoyama, Tokyo (JP); Kentaro Toda, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 28 days.

(21) Appl. No.: 14/106,316

(22) Filed: Dec. 13, 2013

(65) Prior Publication Data

US 2014/0187097 A1 Jul. 3, 2014

(30) Foreign Application Priority Data

Dec. 28, 2012 (JP) ..... 2012-288184

(51) Int. Cl.

| | |
|---|---|
| ***H01R 24/00*** | (2011.01) |
| ***H01R 12/72*** | (2011.01) |
| ***H01R 12/73*** | (2011.01) |
| ***H01R 13/6467*** | (2011.01) |

(52) U.S. Cl.

CPC ..... *H01R 12/725* (2013.01); *H01R 12/732* (2013.01); *H01R 13/6467* (2013.01)

(58) Field of Classification Search

CPC ..... H01R 23/7073; H01R 23/725; H01R 23/658; H01R 23/02

USPC ..... 439/660, 217, 218

See application file for complete search history.

(56) References Cited

U.S. PATENT DOCUMENTS

| | | | | |
|---|---|---|---|---|
| 7,094,086 | B2 * | 8/2006 | Teicher | 439/173 |
| 7,160,125 | B1 | 1/2007 | Teicher | |
| 7,363,947 | B2 | 4/2008 | Teicher | |
| 7,537,471 | B2 * | 5/2009 | Teicher | 439/172 |
| 7,591,657 | B2 | 9/2009 | Teicher | |
| 7,942,698 | B2 * | 5/2011 | Nanao et al. | 439/607.31 |
| 2007/0010115 | A1 | 1/2007 | Teicher | |

(Continued)

FOREIGN PATENT DOCUMENTS

| | | | |
|---|---|---|---|
| JP | 2008-508694 | A | 3/2008 |
| JP | 2008-210674 | A | 9/2008 |

(Continued)

*Primary Examiner* — Abdullah Riyami
*Assistant Examiner* — Thang Nguyen
(74) *Attorney, Agent, or Firm* — Holtz, Holtz, Goodman & Chick PC

(57) ABSTRACT

A connector includes a plurality of contacts, which are held by a holder member and are arranged in a pitch direction perpendicular to a front-rear direction. Each contact has a terminal portion to be connected and fixed to an object and a connection portion which is, at least in part, held by a plate-like portion of the holder member and is positioned forwards of the terminal portion in the front-rear direction. The connection portion has a first contact portion, a second contact portion and a rear connection portion. The first contact portion is, at least in part, exposed on the first surface. The second contact portion is, at least in part, exposed on the second surface. The rear connection portion connects a rear of the first contact portion with a rear of the second contact portion and is connected to the terminal portion. When the connector is mated with a mating connector, one of the first contact portion and the second contact portion electrically connects a mating contact of the mating connector to the terminal portion.

14 Claims, 9 Drawing Sheets

(56) References Cited

U.S. PATENT DOCUMENTS

| | | | | |
|---|---|---|---|---|
| 2007/0202725 | A1 | 8/2007 | Teicher | |
| 2007/0293083 | A1 * | 12/2007 | Wang et al. | 439/541.5 |

FOREIGN PATENT DOCUMENTS

| | | | |
|---|---|---|---|
| JP | 2010-510640 | A | 4/2010 |
| JP | 2011-082068 | A | 4/2011 |

* cited by examiner

REVERSIBLE CONNECTOR

CROSS REFERENCE TO RELATED APPLICATIONS

An applicant claims priority under 35 U.S.C. §119 of Japanese Patent Application No. JP2012-288184 filed Dec. 28, 2012.

BACKGROUND OF THE INVENTION

This invention relates to a connector with which a mating connector is mateable even if the mating connector is relatively reversed.

As shown in FIG. 18, JP-A 2008-508694 discloses a connector (reversible plug) whose mating connector is a Universal Serial Bus (USB) standard receptacle. The mating connector includes an electric contact (mating contact) having a protrusion (contact portion). The connector includes a plate spring (contact) and an insulation cap. The plate spring is formed by bending a plate-like member back and includes a first section and a second section. The insulation cap is attached to an end of the plate spring, i.e., a boundary portion between the first section and the second section. The first section continues to a terminal portion which is to be connected to a circuit board (not shown). On the other hand, the second section is not electrically connected with sections other than the first section. Namely, the second section is electrically connected only with the first section.

When the connector of JP-A 2008-508694 is mated with the mating connector, the insulation cap rides over the protrusion (contact portion) of the electrical contact (mating contact) so that any one of the first section and the second section of the plate spring is brought into contact with the protrusion (contact portion).

In the connector of JP-A 2008-508694, the second section is almost same in length as the first section but is not directly connected to the terminal portion. Therefore, various problems might occur upon signal transmission.

For example, the connector of JP-A 2008-508694 is mateable with the mating connector while the mating connector is under a normal state or non-reversed state shown in FIG. 18 or under a reversed state thereof. When the connector of JP-A 2008-508694 is mated with the mating connector under the reversed state, the contact portion of the mating connector is in contact with the second section. Under the contacting state, the second section is connected through the first section to the terminal section. Therefore, an electrical path of a connection between the contact portion of the mating connector and the terminal portion of the connector becomes larger than another electrical path under the normal state shown in FIG. 18. In other words, the connector of JP-A 2008-508694 has a problem that a difference occurs between electrical paths of connections between the contact portion of the mating connector and the terminal portions under the normal state and the reversed state so that signal transmission times for the normal state and the reversed state are different from each other. As described above, if a length of a signal transmission path changes, transmission characteristics for high-speed transmission vary.

SUMMARY OF THE INVENTION

It is therefore an objective of the present invention to provide a connector which can be mated with a mating connector under any one of the normal state and the reversed state while lengths of signal transmission paths for both states do not have differences that will substantially turn into problems.

One aspect of the present invention provides a connector to be attached and fixed to an object. The connector comprises a mating end, a holder member and a plurality of contacts. The mating end is positioned at a front end of the connector in a front-rear direction. The mating end is to be mated with a mating connector which has a plurality of mating contacts. The holder member includes a plate-like portion which has a first surface and a second surface. The contacts correspond to the mating contacts, respectively. The contacts are held by the holder member and arranged in a pitch direction perpendicular to the front-rear direction. Each of the contacts has a terminal portion and a connection portion. The terminal portion is to be connected and fixed to the object. The connection portion is, at least in part, held by the plate-like portion and is positioned forwards of the terminal portion in the front-rear direction. The connection portion has a first contact portion, a second contact portion and a rear connection portion. The first contact portion is, at least in part, exposed on the first surface. The second contact portion is, at least in part, exposed on the second surface. The rear connection portion connects a rear of the first contact portion with a rear of the second contact portion and is connected to the terminal portion. One of the first contact portion and the second contact portion electrically connects a corresponding one of the mating contacts to the terminal portion when the connector is mated with the mating connector.

Since the aforementioned connector includes two contact portions of the first contact portion and the second contact portion, the connector can be connected with the mating connector under either a normal state or a reversed state.

The connection portion of each contact of the aforementioned connector includes the rear connection portion which connects the rear of the first contact portion with the rear of the second contact portion and is connected to the terminal portion. Therefore, even when the aforementioned connector is mated with the mating connector under any one of the normal state and the reversed state, lengths of signal transmission paths for the states do not have differences that will substantially turn into problems.

The second section of the connector of the above-cited JP-A 2008-508694 forms an open stub which has a relatively large size. "Open stub" is an open end or a section at a dead end for transmission path or current flow. Existence of such open stub is not suitable for high-frequency signal transmission. On the other hand, if the first contact portion and the second contact portion form a part of a closed path, for example, as recited in the original claim 2 of the present application, the connector has no open stub which has a large size that turns problems on high-frequency signal transmission. Therefore, the connector can suppress degradation of signal quality.

An appreciation of the objectives of the present invention and a more complete understanding of its structure may be had by studying the following description of the preferred embodiment and by referring to the accompanying drawings.

Figure 1:
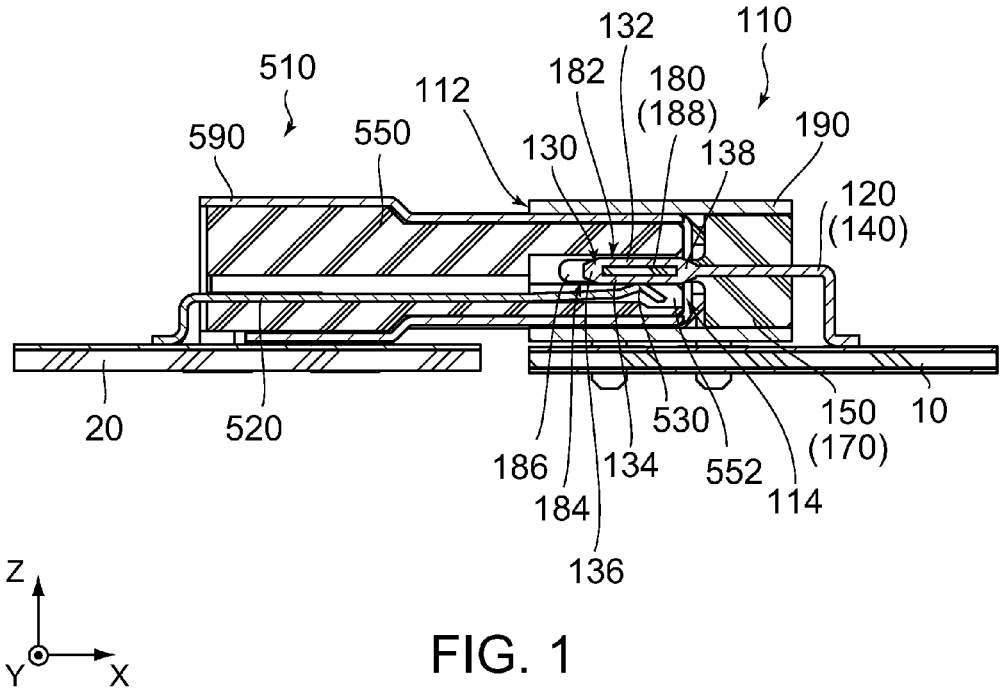
FIG. 1 is a cross-sectional view showing a connector and a mating connector according to a first embodiment of the present invention, wherein the connector is mated with the mating connector under a normal state.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 2:
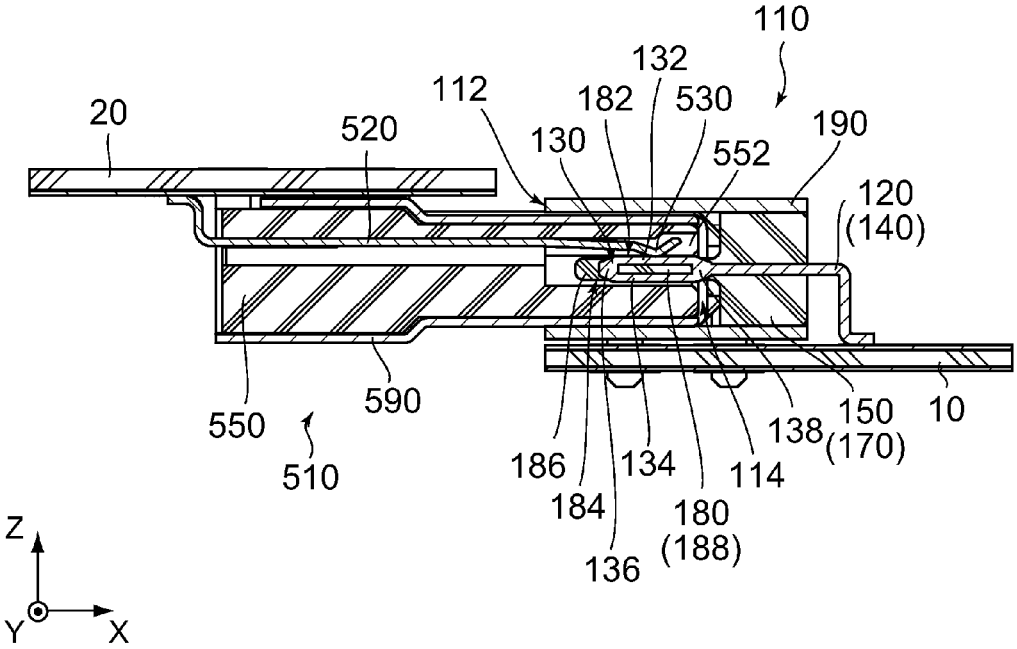
FIG. 2 is another cross-sectional view showing the connector and the mating connector of FIG. 1, wherein the connector is mated with the mating connector under a reversed state.

With reference to FIGS. 1 and 2, a connector 110 according to a first embodiment of the present invention is attached and fixed to a circuit board (object) 10, while a mating connector 510 is attached and fixed to a mating circuit board 20. The connector 110 according to the present embodiment has a mating end 112 which is positioned at a front end (negative X-end) of the connector 110 in a front-rear direction (X-direction) and is to be mated with the mating connector 510. The connector 110 is mateable with the mating connector 510 even when the mating connector 510 is upside down. In other words, the connector 110 is mateable with the mating connector 510 while the mating connector 510 is under a normal state or non-reversed state shown in FIG. 1 or under a reversed state shown in FIG. 2.

The illustrated mating connector 510 comprises a plurality of mating contacts 520 made of conductor, a mating holder member 550 made of insulator, and a mating shell 590 made of metal. The mating holder member 550 holds the plurality of mating contacts 520. The mating holder member 550 has separation portions 552 each of which is positioned between neighboring ones of the mating contacts 520 in a pitch direction (Y-direction). Each mating contact 520 has a resilience and includes a mating contact portion 530 which is movable in a up-down direction (Z-direction) by using the resilience thereof. The mating contacts 520, especially the mating contact portions 530 and therearound, are protected by the separation portions 552 which are provided close thereto in the pitch direction. The mating shell 590 covers the mating holder member 550.

The mating end 112 of the connector 110 according to the present embodiment opens. The connector 110 further has a reception portion 114. The reception portion 114 is positioned rearwards, or towards the positive X-side, of the mating end 112 of the connector 110 and is to partially receive the mating connector 510. The connector 110 comprises a plurality of contacts 120 made of conductor, a holder member 150 made of insulator, and a shell 190 made of metal. The holder member 150 holds the plurality of contacts 120. The shell 190 covers the holder member 150.

The holder member 150 includes a block portion 170 and a plate-like portion 180 which extends forwards, or towards the negative X-side, from the block portion 170. The plate-like portion 180 has a first surface (upper surface; positive Z-side surface) 182 and a second surface (lower surface; negative Z-side surface) 184 which is the back surface of the first surface 182. The plate-like portion 180 has a thin portion 186 and thick portion 188 which is thicker in material thickness than the thin portion 186. In other words, the thick portion 188 has a large size than that of the thin portion 186 in the up-down direction. In the present embodiment, the thin portion 186 is positioned forwards, or towards the negative X-side, of the thick portion 188.

The illustrated contacts 120 are formed by punching a metal plate out and are partially embedded in the holder member 150 via insert-molding. Each contact 120 includes a connection portion 130 and a terminal portion 140. The connection portion 130 is held by the plate-like portion 180 and forms a closed path. The terminal portion 140 extends rearwards from the connection portion 130. The entire connection portion 130 may not be held by the plate-like portion 180. For example, a part of the connection portion 130 may be embedded within the block portion 170. The connection portion 130 is positioned forwards, or towards the negative X-side, of the terminal portion 140. In this embodiment, the terminal portion 140 is connected and fixed to the circuit board 10.

The connection portion 130 according to the present embodiment forms the closed path even before the contact 120 is held by the holder member 150, or before the contact 120 is partially embedded in the holder member 150. The connection portion 130 includes a first contact portion 132, a second contact portion 134, a front connection portion 136 and a rear connection portion 138. The second contact portion 134 is positioned downwards, or towards the negative Z-side, of the first contact portion 132. The front connection portion 136 connects the front, or the negative X-side, of the first contact portion 132 with the front, or the negative X-side, of the second contact portion 134. The rear connection portion 138 connects the rear, or the positive X-side, of the first contact portion 132 with the rear, or the positive X-side, of the second contact portion 134. The aforementioned closed path is formed by the first contact portion 132, the second contact portion 134, the front connection portion 136 and the rear connection portion 138. The terminal portion 140 extends rearwards, or towards the positive X-direction, from the rear connection portion 138.

The first contact portion 132 and the second contact portion 134 extend along the front-rear direction. The first contact portion 132 is partially exposed on the first surface 182 of the plate-like portion 180. The second contact portion 134 is partially exposed on the second surface 184 of the plate-like portion 180. In detail, the first contact portion 132 and the second contact portion 134 are partially exposed on the thick portion 188 of the plate-like portion 180.

Because of exposure of the first contact portion 132 on the first surface 182 and exposure of the second contact portion 134 on the second surface 184, the mating contact portion 530 of each mating contact 520 can be electrically connected to the terminal portion 140 through any one of the first contact portion 132 and the second contact portion 134 when the connector 110 is mated with the mating connector 510.

As described above, the rear connection portion 138 connects the rear of the first contact portion 132 with the rear of the second contact portion 134 and is connected to the terminal portion 140. Therefore, even when the connector 110 is mated with the mating connector 510 under any one of the normal state and the reversed state, lengths of signal transmission paths for the states do not have differences that will substantially turn into problems.

In addition, since the first contact portion 132 and the second contact portion 134 are formed as parts of the connection portion 130 forming the closed path, an open stub that turns into problems upon high-frequency signal transmission is not formed, and degradation or instability of signal quality can be prevented.

The closed path may have various shapes such as square, rectangle, triangle, polygon more angular than pentagon, elliptical shape and track-like shape.

In the up-down direction, the size of the connection portion 130 is slightly larger than the size of the thick portion 188 of the plate-like portion 180. Since the thin portion 186 is smaller than the thick portion 188 for size in the up-down direction, or is thinner than the thick portion 188, the thin portion 186 is smaller than the connection portion 130 for size in the up-down direction. Therefore, the connection portion 130 according to the present embodiment is visible, as the front of the connector 110 is seen along the front-rear direction.

As described above, because of existence of the thin portion 186, the mating contact portion 530 of the mating contact 520 rides on the thin portion 186 and then rides on the first contact portion 132 or the second contact portion 134 when the connector 110 is mated with the mating connector 510. Thus, the mating contact 520 is not deformed sharply. Therefore, the present embodiment can reduce buckling of the mating contact 520.

Second Embodiment

Figure 3:
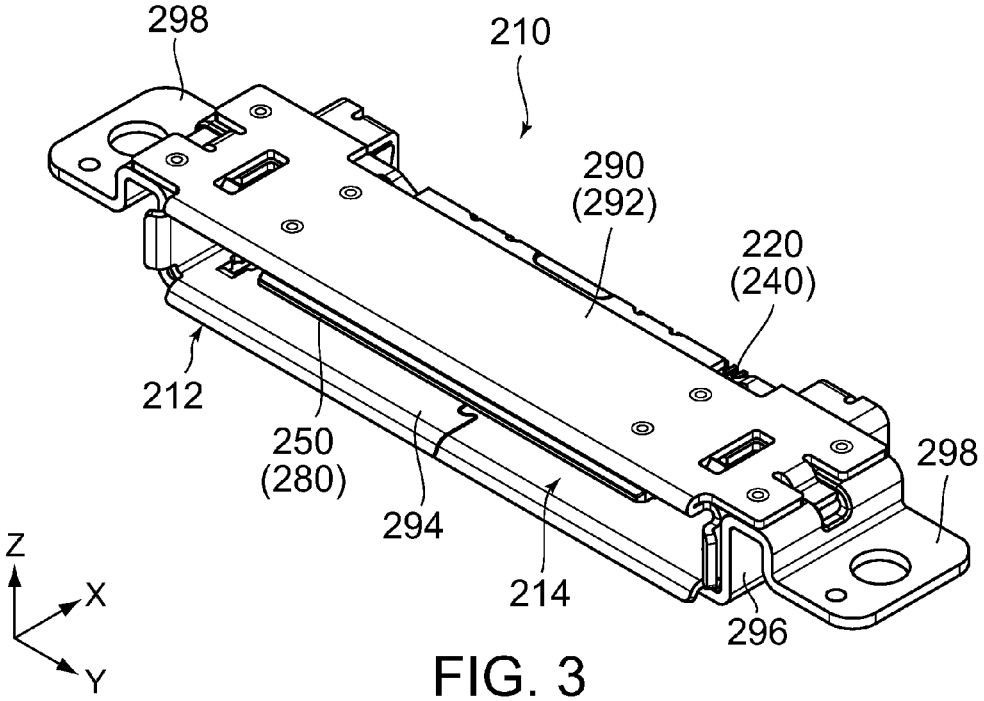
FIG. 3 is a top oblique view showing a connector according to a second embodiment of the present invention.
Figure 4:
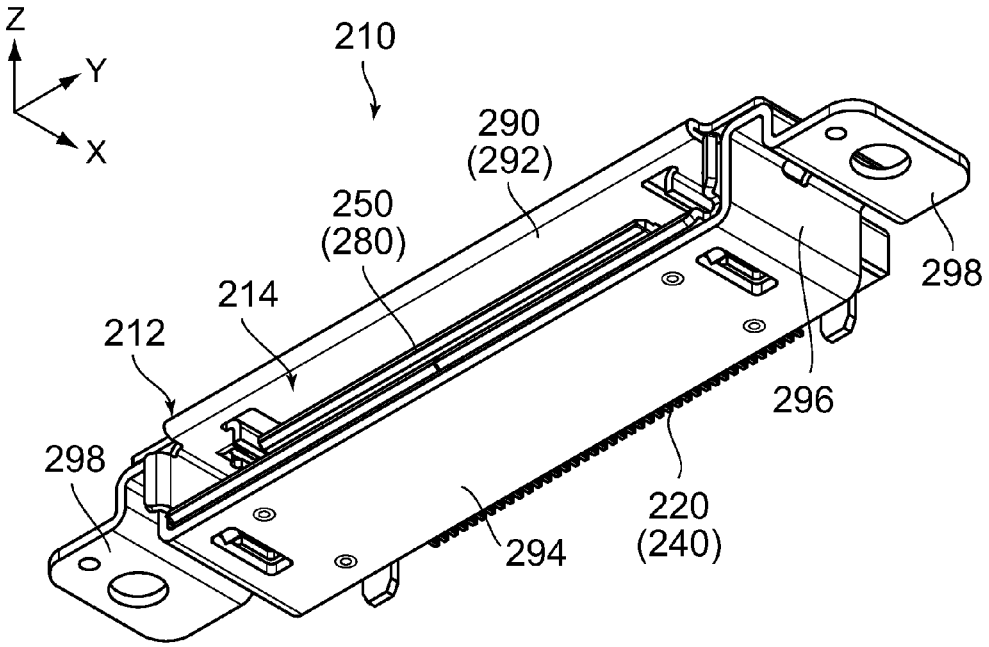
FIG. 4 is a bottom oblique view showing the connector of FIG. 3.
Figure 5:
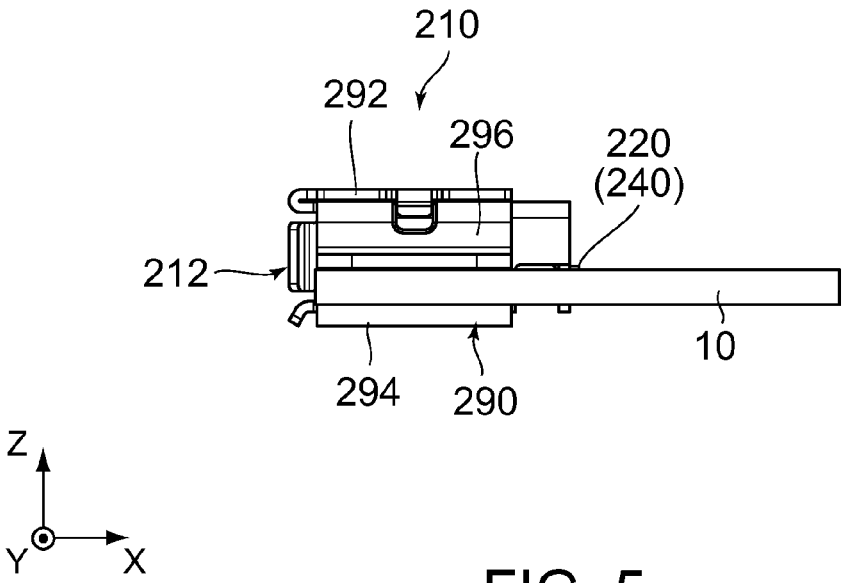
FIG. 5 is a side view showing the connector of FIG. 3, wherein the connector is attached to a circuit board.

With reference to FIGS. 3 to 5, a connector 210 according to a second embodiment of the present invention is a modification of the connector 110 according to the first embodiment (see FIGS. 1 and 2) and is mateable with the aforementioned mating connector 510 along the front-rear direction (X-direction). The connector 210 is attached and fixed to the circuit board (object) 10, as shown in FIG. 5.

As shown in FIGS. 3 and 4, the connector 210 according to the present embodiment has a mating end 212 which is positioned at a front end (negative X-end) of the connector 210 in a front-rear direction (X-direction) and is to be mated with the mating connector 510. The connector 210 is mateable with the mating connector 510 even when the mating connector 510 is upside down. The mating end 212 of the connector 210 according to the present embodiment opens. The connector 210 further has a reception portion 214. The reception portion 214 is positioned rearwards, or towards the positive X-side, of the mating end 212 of the connector 210 and is to partially receive the mating connector 510.

The connector 210 comprises a plurality of contacts 220 made of conductor, a holder member 250 made of insulator, and a shell 290 made of metal.

As understood from FIGS. 3 to 6 and 8, the shell 290 covers the holder member 250. As shown in FIGS. 3 to 5, the shell 290 includes a top portion 292, a bottom portion 294, a pair of sidewall portions 296 and a pair of fixing portions 298. Each of the top portion 292 and the bottom portion 294 extends long in a pitch direction (Y-direction). Each of the sidewall portions 296 couples between the top portion 292 and the bottom portion 294 in an up-down direction (Z-direction). As shown in FIGS. 3 and 4, the top portion 292, the bottom portion 294 and the sidewall portions 296 form the above-described reception portion 214 substantially. Each of the fixing portions 298 extends outwards in the pitch-direction. The fixing portions 298 are used for fixing the connector 210 to the circuit board 10 by soldering or by screws. The illustrated fixing portions 298 are positioned between the top portion 292 and the bottom portion 294 in the up-down direction. In other words, the fixing portions 298 are positioned upwards, or towards the positive Z-side, of the bottom portion 294. While the connector 210 is received within a cutaway (not shown) of the circuit board 10, the fixing portions 298 are fixed on the circuit board 10. Thus, the connector 210 is low-profiled.

As shown in FIGS. 6 to 10, the holder member 250 holds the plurality of contacts 220. The holder member 250 includes a block portion 270 and a plate-like portion 280 which extends forwards, or towards the negative X-direction, from the block portion 270. The plate-like portion 280 has a first surface (upper surface; positive Z-side surface) 282 and a second surface (lower surface; negative Z-side surface) 284 which is the back surface of the first surface 282. The plate-like portion 280 has a thin portion 286 and thick portion 288 which is thicker in material thickness than the thin portion 286. In other words, the thick portion 288 has a large size than that of the thin portion 286 in the up-down direction (Z-direction). In the present embodiment, the thin portion 286 is positioned forwards, or towards the negative X-side, of the thick portion 288.

The illustrated contacts 220 are partially embedded in the holder member 250 via insert-molding and are held thereby. The holding arranges the contacts 220 in the pitch direction (Y-direction). In this embodiment, some of the contacts 220 have different sizes, or lengths, than others in order to shift timings of contact with the mating contacts 520 to allow hot plugging. However, their basic structures are same as each other.

As shown in FIGS. 11 to 14, each contact 220 includes a connection portion 230 and a terminal portion 240 which extends from the connection portion 230. The connection portion 230 is held by the plate-like portion 280 and forms a closed path. The entire connection portion 230 may not be held by the plate-like portion 280. For example, a part of the connection portion 230 may be embedded within the block portion 270. The connection portion 230 is positioned forwards, or towards the negative X-side, of the terminal portion 240. As shown in FIG. 5, the terminal portion 240 according to the present embodiment is connected and fixed to the circuit board 10.

Figure 12:
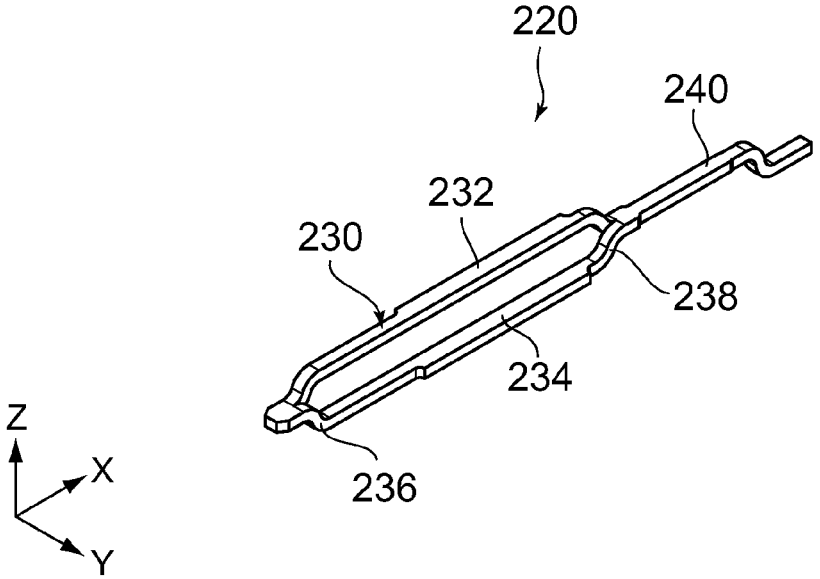
FIG. 12 is an enlarged, oblique view showing one of the contacts of FIG. 11.
Figure 13:
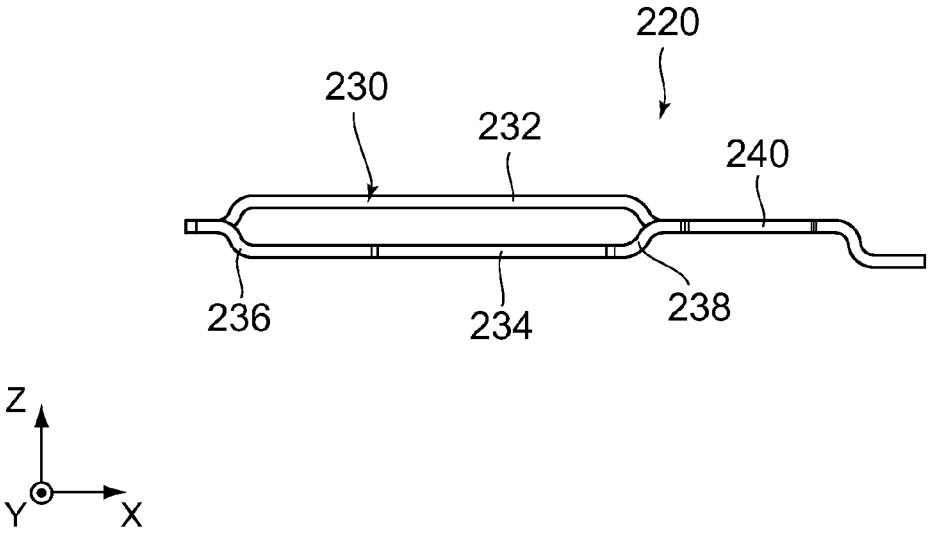
FIG. 13 is a side view showing the contact of FIG. 12.
Figure 14:
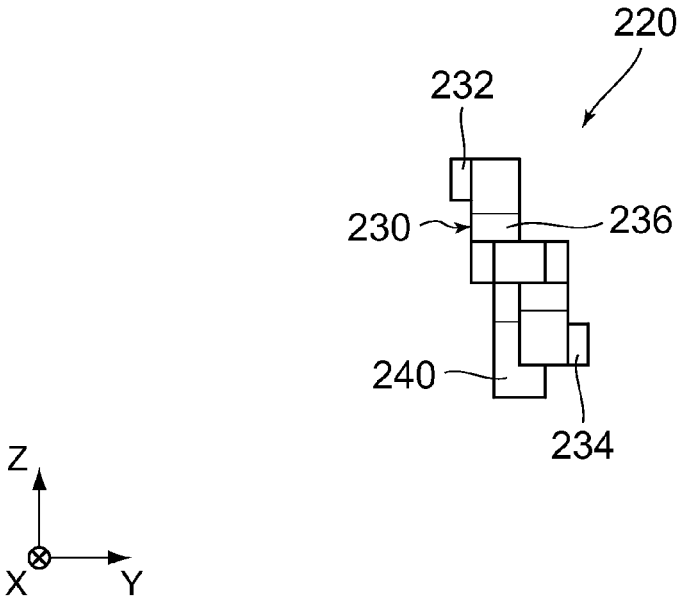
FIG. 14 is a front view showing the contact of FIG. 12.

As best shown in FIGS. 12 and 13, the connection portion 230 according to the present embodiment forms the closed path even before the contact 220 is held by the holder member 250, or before the contact 220 is partially embedded in the holder member 250. The connection portion 230 includes a first contact portion 232, a second contact portion 234, a front connection portion 236 and a rear connection portion 238. The front connection portion 236 connects the front, or the negative X-side, of the first contact portion 232 with the front, or the negative X-side, of the second contact portion 234. The rear connection portion 238 connects the rear, or the positive X-side, of the first contact portion 232 with the rear, or the positive X-side, of the second contact portion 234. The aforementioned closed path is formed by the first contact portion 232, the second contact portion 234, the front connection portion 236 and the rear connection portion 238. The terminal portion 240 extends rearwards, or towards the positive X-direction, from the rear connection portion 238.

Figure 15:
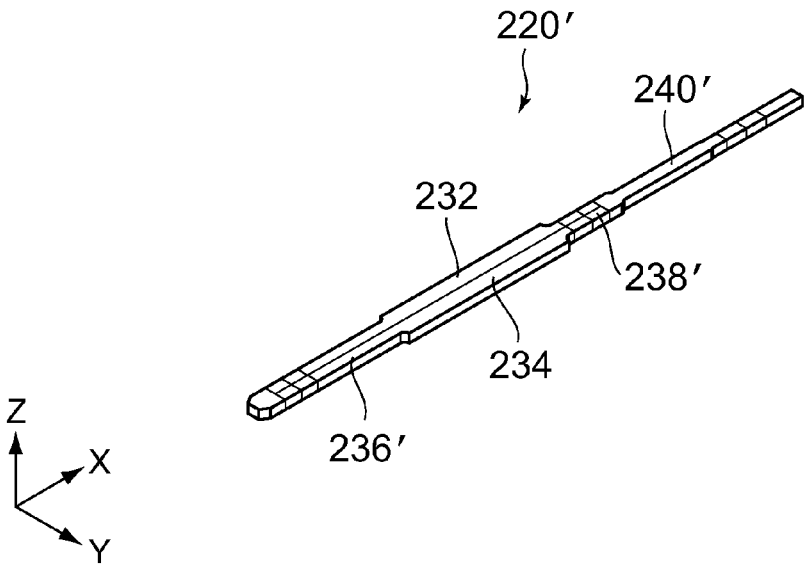
FIG. 15 is an oblique view showing an intermediate member which is formed during a fabrication process of the contact of FIG. 12.

The first contact portion 232 and the second contact portion 234 extend along the front-rear direction. The second contact portion 234 is positioned downwards, or towards the negative Z-side, of the first contact portion 232. Namely, the first contact portion 232 and the second contact portion 234 are positioned apart from each other in the up-down direction (Z-direction), similar to the first contact portion 132 and the second contact portion 134 of the contact 120 of the aforementioned first embodiment. Although the first contact portion 132 and the second contact portion 134 of the contact 120 of the aforementioned first embodiment are positioned at positions same as each other in the pitch direction (Y-direction), the first contact portion 232 and the second contact portion 234 of the present embodiment are positioned at positions different from each other in the pitch direction, as understood from FIGS. 12 and 14, and do not overlap each other in the pitch direction. For example, the contact 220 is formed by punching out a metal plate to obtain an intermediate member 220' (see FIG. 15), followed by bending the intermediate member 220'. In FIG. 15, each of a width of a section 236' and a width a section 238' is narrower, or smaller in Y-directional size, than a total width of the first contact portion 232 and the second contact portion 234, in order to achieve fine tolerances on punching process of the first contact portion 232 and the second contact portion 234. When the section 236' and the section 238' of the intermediate member 220' are bent and deformed so that the first contact portion 232 is moved upwards, or towards the positive Z-side, while the second contact portion 234 is moved downwards, or towards the negative Z-side. Thus, the front connection portion 236 and the rear connection portion 238 are formed. Then, the section 240' is bent so that the terminal portion 240 is formed.

As shown in FIGS. 6 to 9, the first contact portion 232 is partially exposed on the first surface 282 of the plate-like portion 280, while the second contact portion 234 is partially exposed on the second surface 284 of the plate-like portion 280. The first contact portion 232 and the second contact portion 234 are partially exposed on the thick portion 288 of the plate-like portion 280.

Because of exposure of the first contact portion 232 on the first surface 282 and exposure of the second contact portion 234 on the second surface 284, the mating contact portion 530 of each mating contact 520 can be electrically connected to the terminal portion 240 through any one of the first contact portion 232 and the second contact portion 234 when the connector 210 is mated with the mating connector 510.

Figure 6:
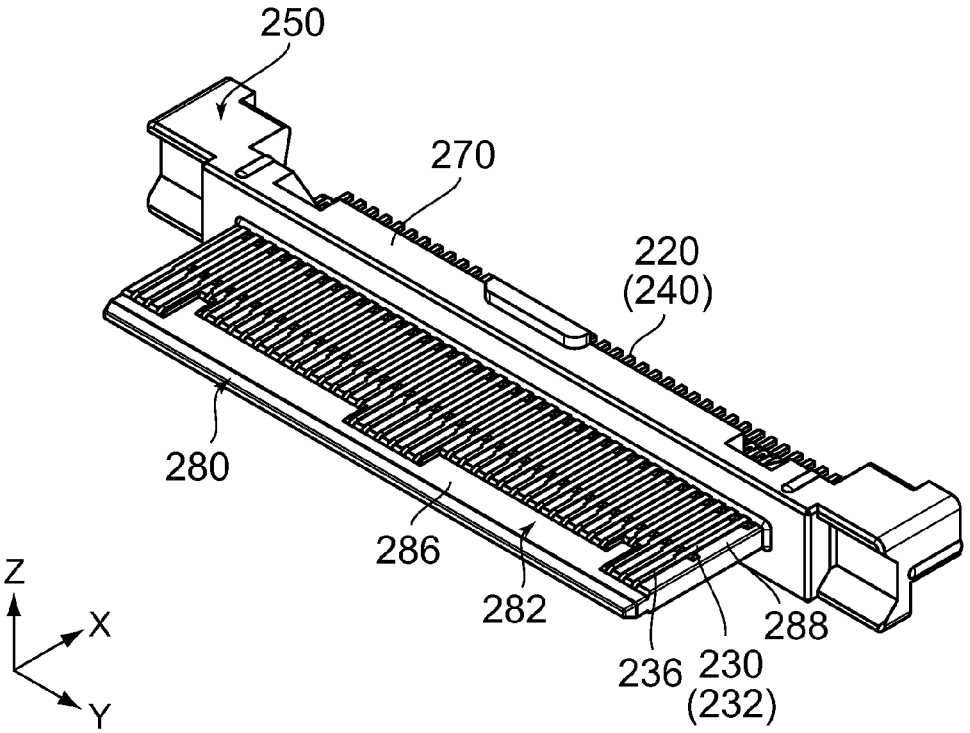
FIG. 6 is a top oblique view showing contacts and a holder member which are included in the connector of FIG. 3.
Figure 7:
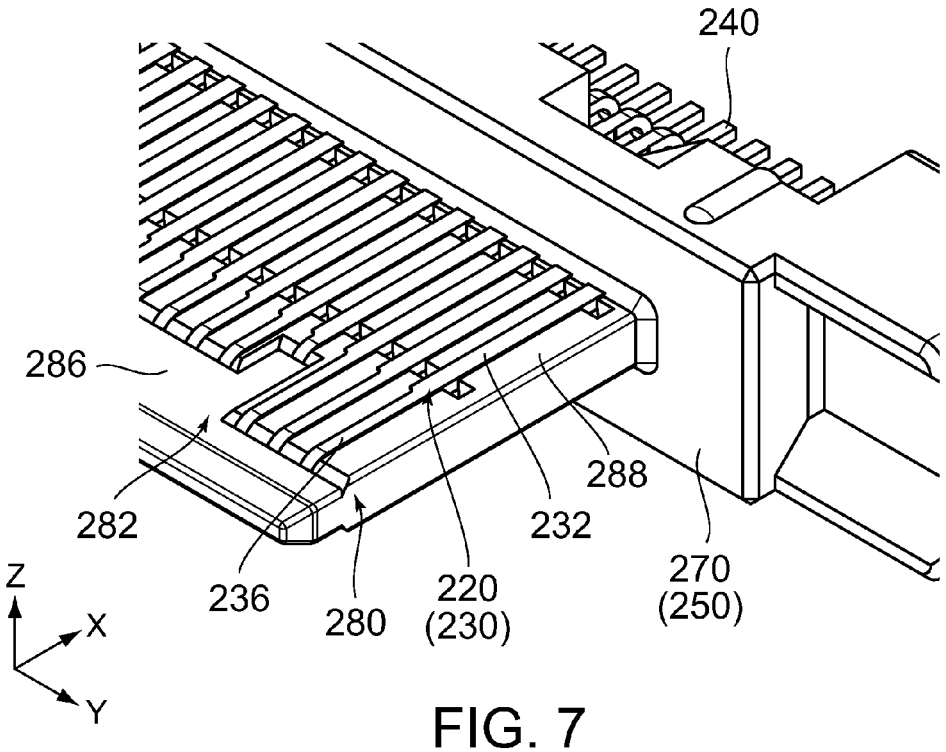
FIG. 7 is an enlarged view showing a part of the contacts and the holder member of FIG. 6.
Figure 8:
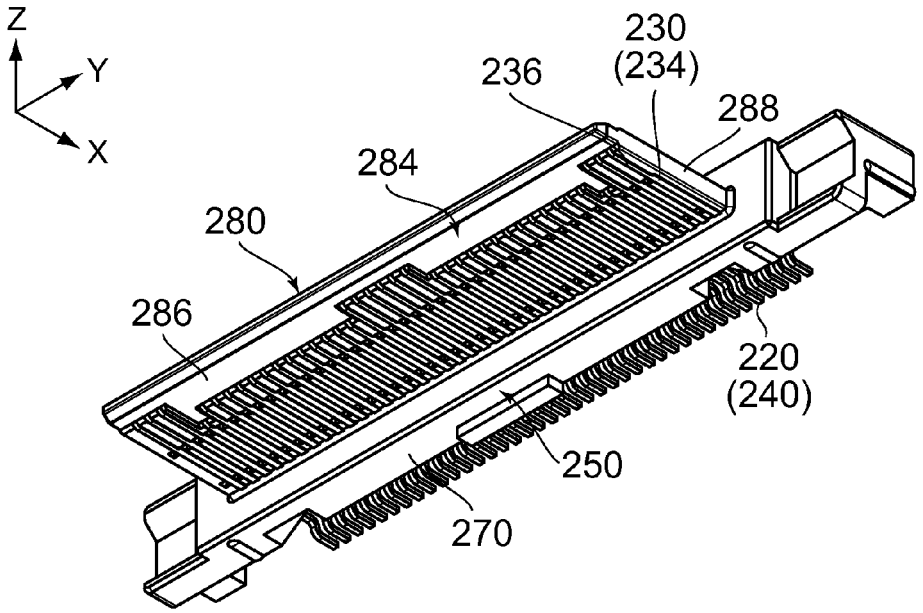
FIG. 8 is a bottom oblique view showing the contacts and the holder member of FIG. 6.

As understood from FIGS. 6 to 8, the contacts 220 are arranged in 2-fold rotational symmetry, or discrete rotational symmetry of the second order, with respect to an axis which extends parallel to the X-direction and which passes through a point that is a midpoint of the plate-like portion 280 in the pitch direction (Y-direction) and is also a midpoint of the plate-like portion 280 in the up-down direction (Z-direction). Because of the arrangement, even if the mating connector 510 is reversed, the connector 210 can be mated and connected with the mating connector 510.

As described above, the rear connection portion 238 connects the rear of the first contact portion 232 with the rear of the second contact portion 234 and is connected to the terminal portion 240. Therefore, even when the connector 210 is mated with the mating connector 510 under any one of the normal state and the reversed state, lengths of signal transmission paths for the states do not have differences that will substantially turn into problems.

In addition, since the first contact portion 232 and the second contact portion 234 are formed as parts of the connection portion 230 of the closed path, an open stub that turns into problems upon high-frequency signal transmission can be reduced, and degradation or instability of signal quality can be prevented.

The closed path may have various shapes such as square, rectangle, triangle, polygon more angular than pentagon, elliptical shape and track-like shape.

Figure 9:
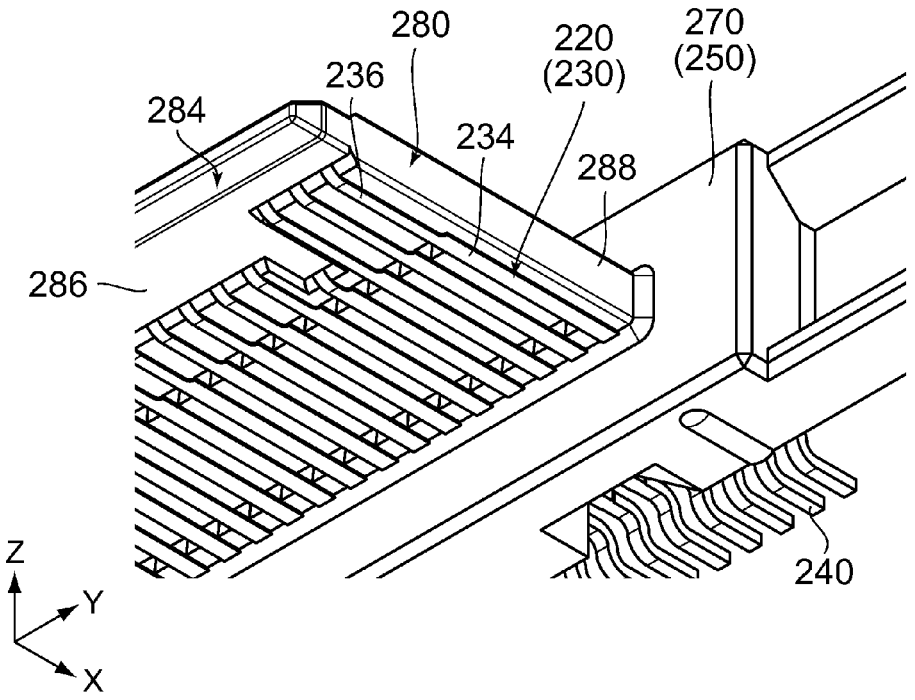
FIG. 9 is an enlarged view showing a part of the contacts and the holder member of FIG. 8.
Figure 10:
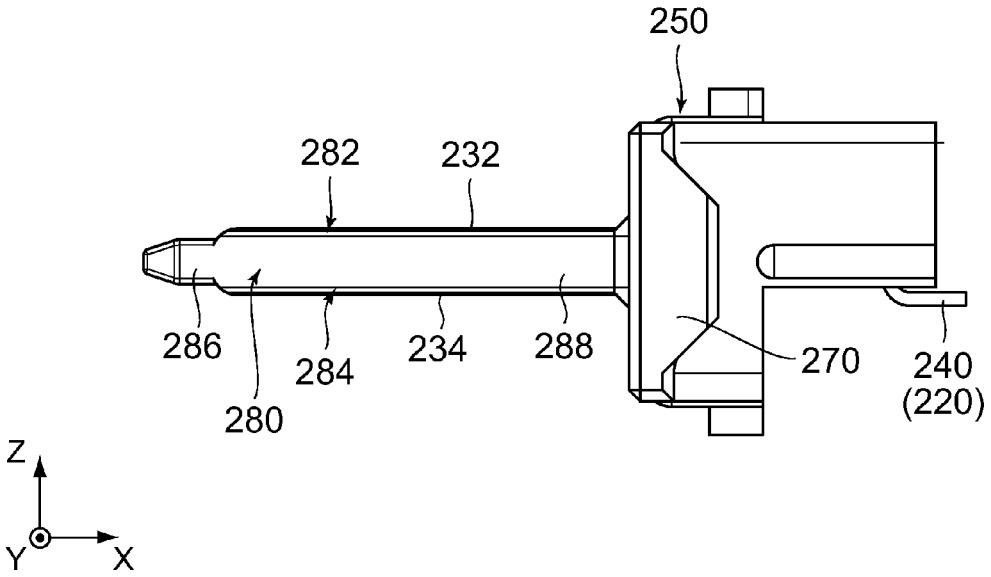
FIG. 10 is a side view showing the contact and the holder member of FIG. 6.
Figure 11:
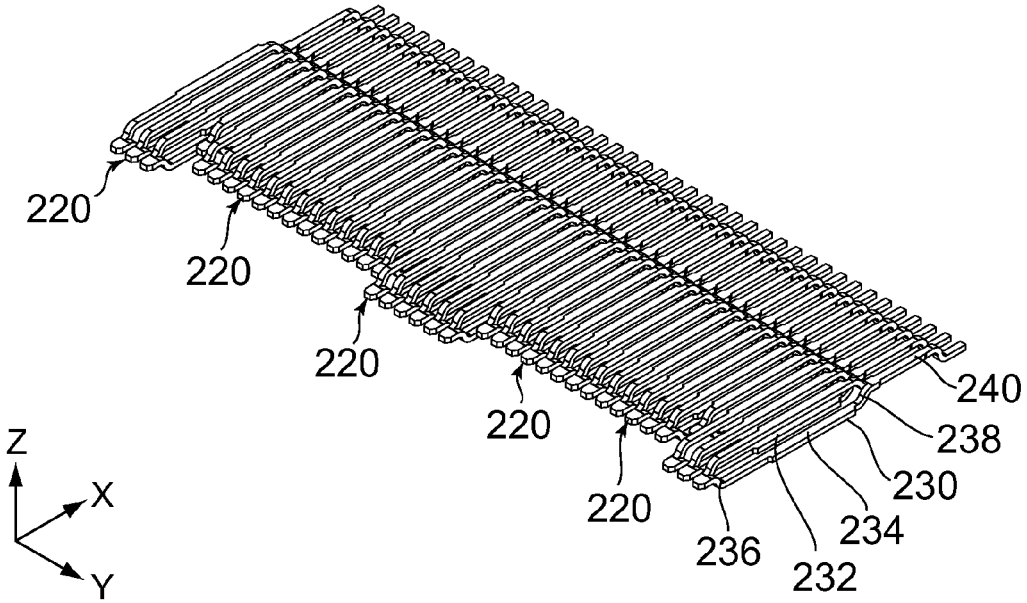
FIG. 11 is a top oblique view showing the plurality of contacts of FIG. 6.

In the up-down direction, the size of the connection portion 230 is slightly larger than the size of the thick portion 288 of the plate-like portion 280. Since the thin portion 286 is smaller than the thick portion 288 for size in the up-down direction, or is thinner than the thick portion 288, the thin portion 286 is smaller than the connection portion 230 for size in the up-down direction. Therefore, as best shown in FIGS. 7 and 9, the connection portion 230 according to the present embodiment is visible, as the front of the connector 210 is seen along the front-rear direction.

As described above, because of existence of the thin portion 286, the mating contact portion 530 of the mating contact 520 rides on the thin portion 286 and then rides on the first contact portion 232 or the second contact portion 234 when the connector 210 is mated with the mating connector 510. Thus, the mating contact 520 is not deformed sharply. Therefore, the present embodiment can reduce buckling of the mating contact 520.

Although the present invention is explained concretely and specifically with the first embodiment and the second embodiment, the present invention is not limited thereto. Rather, the present invention can be modified or applied in various ways.

For example, although the contacts 120, 220 of the aforementioned embodiments are embedded in the holder members 150, 250 via insert-molding, the present invention is not limited thereto. For example, the contacts may be press-fit into the holder member.

Although each of the connection portions 130, 230 of the aforementioned embodiments forms the closed path before the contact 120 or 220 is held by the holder member 150 or 250, the present invention is not limited thereto. Provided that the connection portion forms a complete closed path in the state where the contact is held by the holder member, the connection portion may not form a closed path before the contact is held by the holder member.

Figure 16:
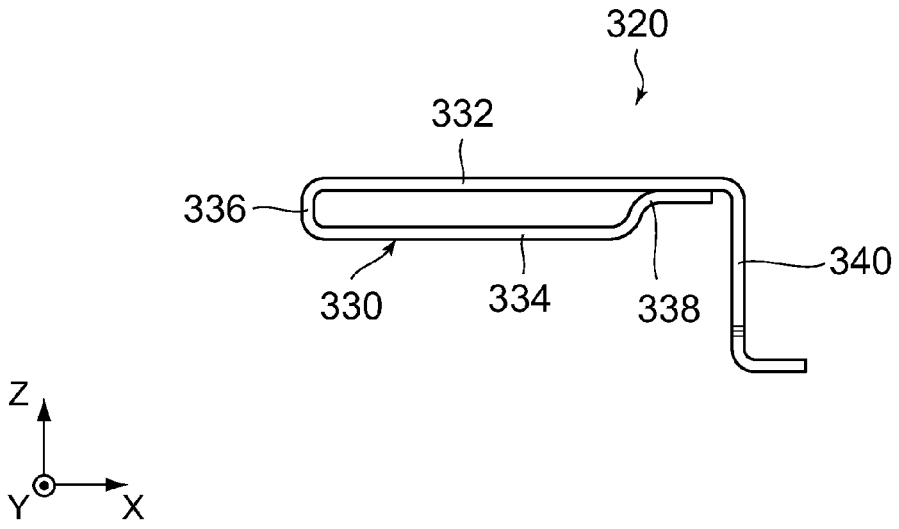
FIG. 16 is a side view showing a modification of the contact.

Specifically, as shown in FIG. 16, a contact 320 may be formed by bending a single elongated conductive material. In the contact 320, a connection portion 330 is constituted by a first contact portion 332, a second contact portion 334, a front connection portion 336 and a rear connection portion 338. A terminal portion 340 extends from the rear, or the positive X-side, of the first contact portion 332. As understood from FIG. 16, before the contact 320 is held by the holder member, the rear connection portion 338 is not fixed to a lower surface of the first contact portion 332 so that the connection portion 330 does not form a complete closed path yet. However, under the state where the contact 320 is held by the holding member, the rear connection portion 338 is fixed to the lower surface of the first contact portion 332 so that the connection portion 330 forms the complete closed path. With the contact 320 held by the holder member, an open stub that turns into problems upon high-frequency signal transmission is not formed. The rear connection portion 338 connects the rear of the first contact portion 332 with the rear of the second contact portion 334 and is connected to the terminal portion 340 under the state where the contact 320 is held by the holder member. Therefore, even when the connector is mated with the mating connector under any one of the normal state and the reversed state, lengths of signal transmission paths for the states do not have differences that will substantially turn into problems.

Although the connection portion 130, 230 or 330 forms the closed path in order to reduce an open stub that turns into problems, the closed path may not be formed, provided that a difference between transmission paths is limited so as not to turn into problems.

Figure 17:
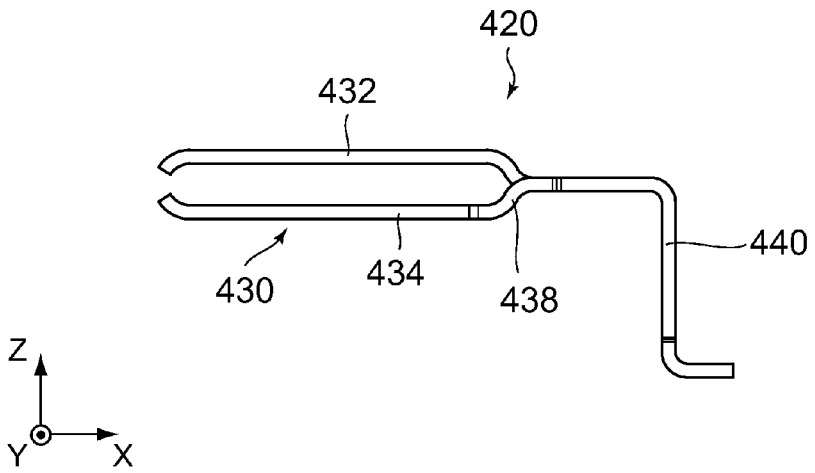
FIG. 17 is a side view showing another modification of the contact.
Figure 18:
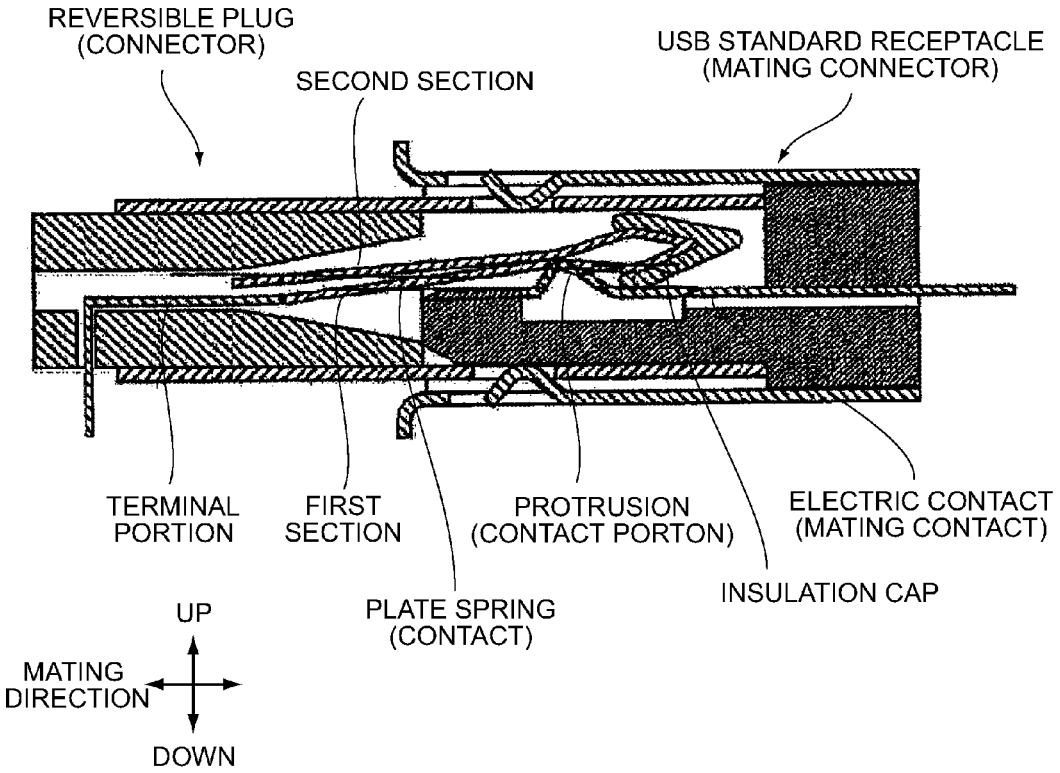
FIG. 18 PRIOR ART
FIG. 18 is a cross-sectional view showing the connector and the mating connector of JP-A 2008-508694.

For example, as shown in FIG. 17, a contact 420 includes a connection portion 430 and a terminal portion 440 which extends from the connection portion 430. The connection portion 430 includes a first contact portion 432, a second contact portion 434 and a rear connection portion 438 which connects the rear of the first contact portion 432 with the rear of the second contact portion 434. Unlike the aforementioned embodiments or the modification, the connection portion 430 does not include a front connection portion. In other words, the front of the first contact portion 432 and the front of the second contact portion 434 are not connected with each other so that the connection portion 430 does not form a closed path.

The contact 420 is formed by punching a single metal plate out, followed by bending the punched metal plate. Specifically, the contact 420 is formed in a way similar to the contact 220 of the aforementioned second embodiment (see FIGS. 12 to 15), except that the contact 420 does not have a front connection portion, or that the front of the first contact portion 432 and the front of the second contact portion 434 are not connected with each other. The first contact portion 432 and the second contact portion 434 of the contact 420 extend along the front-rear direction. The second contact portion 434 is positioned downwards, or towards the negative Z-side, of the first contact portion 432. Namely, the first contact portion 432 and the second contact portion 434 are positioned apart from each other in the up-down direction (Z-direction). The first contact portion 432 and the second contact portion 434 are positioned at positions different from each other in the pitch direction and do not overlap each other in the pitch direction.

The rear connection portion 438 connects the rear of the first contact portion 432 with the second contact portion 434 and is connected to the terminal portion 440. Therefore, even when the connector is mated with the mating connector under any one of the normal state and the reversed state, lengths of signal transmission paths for the states do not have differences that will substantially turn into problems.

The present application is based on a Japanese patent application of JP2012-288184 filed before the Japan Patent Office on Dec. 28, 2012, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector to be attached and fixed to an object, the connector comprising:

a mating end positioned at a front end of the connector in a front-rear direction, wherein the mating end is adapted to be mated with a mating connector which has a plurality of mating contacts;

a holder member including a plate-like portion which has a first surface and a second surface; and a plurality of contacts corresponding to the mating contacts, respectively, the contacts being held by the holder member and arranged in a pitch direction perpendicular to the front-rear direction, wherein each of the plurality of contacts has a terminal portion and a connection portion, wherein the terminal portion is adapted to be connected and fixed to the object, and the connection portion is, at least in part, held by the plate-like portion and positioned forwards of the terminal portion in the front-rear direction, wherein the connection portion has a first contact portion, a second contact portion, a front connection portion and a rear connection portion, the first contact portion being, at least in part, exposed on the first surface, the second contact portion being, at least in part, exposed on the second surface, the front connection portion connecting a front of the first contact portion with a front of the second contact portion, and the rear connection portion connecting a rear of the first contact portion with a rear of the second contact portion and being connected to the terminal portion, wherein one of the first contact portion and the second contact portion electrically connects a corresponding one of the mating contacts to the terminal portion when the connector is mated with the mating connector, and wherein under a state where each of the plurality of contacts is held by the holder member, the first contact portion, the second contact portion, the front connection portion and the rear connection portion of the contact form a single, closed path.

2. The connector as recited in claim 1, wherein the connection portion forms the closed path before the contact is held by the holder member.

3. The connector as recited in claim 2, wherein:

the first contact portion and the second contact portion extend in parallel with each other;

the front connection portion and the rear connection portion are formed by bending; and in the pitch direction and an up-down direction perpendicular both to the front-rear direction and the pitch direction, the first contact portion and the second contact portion are positioned away from each other.

4. The connector as recited in claim 1, wherein the connection portion is formed by bending a single elongated conductive material.

5. The connector as recited in claim 1, wherein the contacts are embedded in the holder member via insert-molding.

6. A connector to be attached and fixed to an object, the connector comprising:

a mating end positioned at a front end of the connector in a front-rear direction, wherein the mating end is adapted to be mated with a mating connector which has a plurality of mating contacts;

a holder member including a plate-like portion which has a first surface and a second surface; and a plurality of contacts corresponding to the mating contacts, respectively, the contacts being held by the holder member and arranged in a pitch direction perpendicular to the front-rear direction, wherein each of the plurality of contacts has a terminal portion and a connection portion, wherein the terminal portion is adapted to be connected and fixed to the object, and the connection portion is, at least in part, held by the plate-like portion and positioned forwards of the terminal portion in the front-rear direction, wherein the connection portion has a first contact portion, a second contact portion and a rear connection portion, the first contact portion being, at least in part, exposed on the first surface, the second contact portion being, at least in part, exposed on the second surface, and the rear connection portion connecting a rear of the first contact portion with a rear of the second contact portion and being connected to the terminal portion, wherein one of the first contact portion and the second contact portion electrically connects a corresponding one of the mating contacts to the terminal portion when the connector is mated with the mating connector, wherein the first contact portion and the second contact portion extend in parallel with each other, wherein the rear connection portion is formed by bending, wherein in the pitch direction and an up-down direction perpendicular both to the front-rear direction and the pitch direction, the first contact portion and the second contact portion are positioned away from each other, and wherein a front of the first contact portion and a front of the second contact portion are not connected with each other.

7. The connector as recited in claim 6, wherein the contacts are embedded in the holder member via insert-molding.

8. The connector as recited in claim 6, wherein:

the plate-like portion has a thin portion and a thick portion;

the thick portion is positioned rearwards of the thin portion in the front-rear direction;

the thick portion is thicker than the thin portion in the up-down direction; and the first contact portion and the second contact portion are exposed on the thick portion.

9. A connector to be attached and fixed to an object, the connector comprising:

a mating end positioned at a front end of the connector in a front-rear direction, wherein the mating end is adapted to be mated with a mating connector which has a plurality of mating contacts;

a holder member including a plate-like portion which has a first surface and a second surface; and a plurality of contacts corresponding to the mating contacts, respectively, the contacts being held by the holder member and arranged in a pitch direction perpendicular to the front-rear direction, wherein each of the plurality of contacts has a terminal portion and a connection portion, wherein the terminal portion is adapted to be connected and fixed to the object, and the connection portion is, at least in part, held by the plate-like portion and positioned forwards of the terminal portion in the front-rear direction, wherein the connection portion has a first contact portion, a second contact portion and a rear connection portion, the first contact portion being, at least in part, exposed on the first surface, the second contact portion being, at least in part, exposed on the second surface, and the rear connection portion connecting a rear of the first contact portion with a rear of the second contact portion and being connected to the terminal portion, wherein one of the first contact portion and the second contact portion electrically connects a corresponding one of the mating contacts to the terminal portion when the connector is mated with the mating connector, wherein the plate-like portion has a thin portion and a thick portion, wherein the thick portion is positioned rearwards of the thin portion in the front-rear direction, wherein the thick portion is thicker than the thin portion in an up-down direction perpendicular both to the front-rear direction and the pitch direction, and wherein the first contact portion and the second contact portion are exposed on the thick portion.

10. The connector as recited in claim 9, wherein the connection portion further has a front connection portion which connects a front of the first contact portion with a front of the second contact portion; and wherein under a state where each of the plurality of contacts is held by the holder member, the first contact portion, the second contact portion, the front connection portion and the rear connection portion of the contact form a single, closed path.

11. The connector as recited in claim 10, wherein the connection portion forms the closed path before the contact is held by the holder member.

12. The connector as recited in claim 11, wherein:

the first contact portion and the second contact portion extend in parallel with each other;

the front connection portion and the rear connection portion are formed by bending; and in the pitch direction and the up-down direction, the first contact portion and the second contact portion are positioned away from each other.

13. The connector as recited in claim 10, wherein the connection portion is formed by bending a single elongated conductive material.

14. The connector as recited in claim 9, wherein the contacts are embedded in the holder member via insert-molding.

* * * * *